US005343446A

United States Patent [19]

Simmons et al.

[11] Patent Number: 5,343,446

[45] Date of Patent: Aug. 30, 1994

[54] PLATOON SCHEDULE WATCH AND METHOD OF PROVIDING A SCHEDULE FOR A USER OF SHIFT START TIMES BOTH PROSPECTIVE AND RETROSPECTIVE

[75] Inventors: John F. Simmons, Santa Ana, Calif.; Terrence Chen, Tsuen Wan, Taiwan

[73] Assignee: Firetime, Inc., Santa Ana, Calif.

[21] Appl. No.: 860,317

[22] Filed: Mar. 30, 1992

[51] Int. Cl.[5] ..... G04C 21/16; G04F 7/00

[52] U.S. Cl. ..... 368/251; 368/41; 368/107; 368/89

[58] Field of Search ..... 368/89, 72, 107–113, 368/41–44; 116/136, 251

[56] References Cited

U.S. PATENT DOCUMENTS 3,780,695 12/1973 Richard ..... 116/136

*Primary Examiner*—Bernard Roskoski
*Attorney, Agent, or Firm*—Wagner & Middlebrook

[57] ABSTRACT

A combination electronic digital wristwatch and electronic shift scheduler using a digital liquid crystal display, enclosed within a watch-type case, for use primarily by firefighters. The invention provides both a device and a method that allows an individual who needs to keep track of platoon and shift schedule information to enter, display, review, search, and modify that information on a full-function wristwatch. The combination includes time and date display, a chronograph function, and an alarm clock with chime. Four switches are connected to a signal conditioner for encoding each switch closure to be input into a CPU which generates the required signals for the display after reference to the calendar information stored in the ROM and the user input information stored in the RAM. The CPU makes the calculations required for the operation of this invention. It also calculates the repeating cycle of the schedule and applies it to the calendar information both prospective and retrospective to determine the platoon assignment for each time interval and its start time. It is preferred that the timepiece be at least water resistant, particularly for its intended application in the firefighting profession.

27 Claims, 14 Drawing Sheets

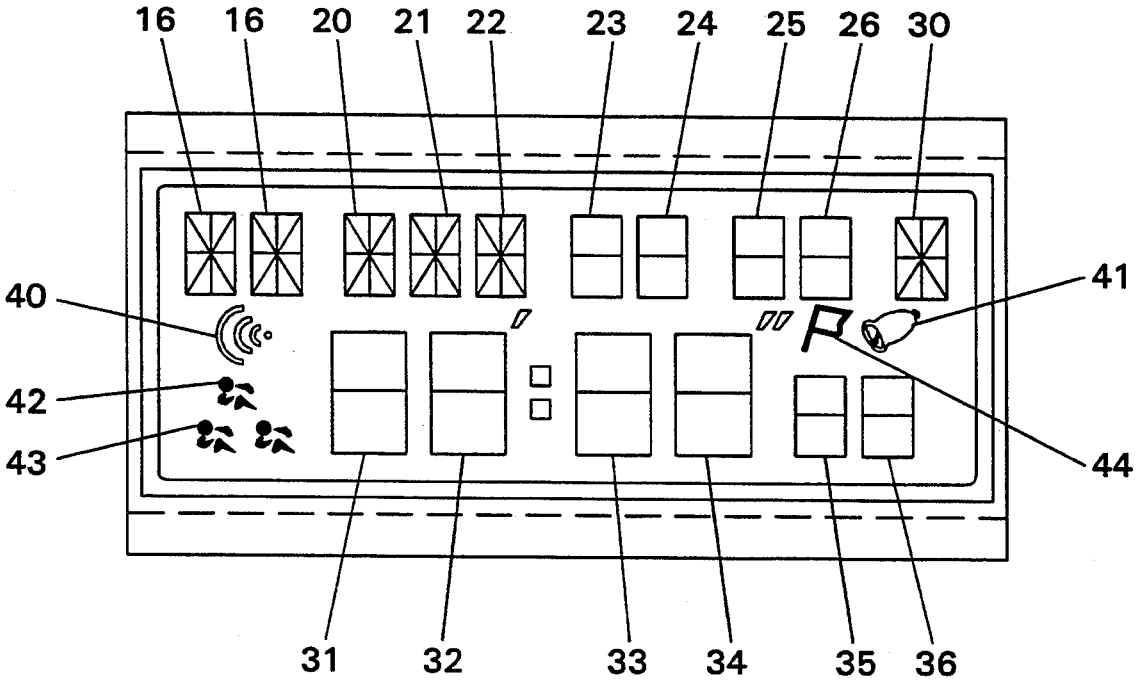
FIG. 2
NORMAL TIME MODE
S1: CHIME SET/RESET
S2: JUMP TO SETTING MODE
S3: JUMP TO NEXT MODE
NORMAL TIME SETTING MODE
S1: INCREMENT THE FLASHING DIGIT
S2: EXIT THE SETTING MODE
S3: SELECT THE FLASHING DIGIT
S4: 12H/24H SELECT
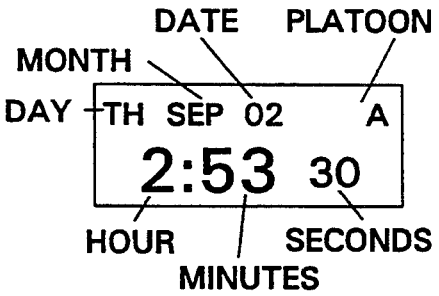
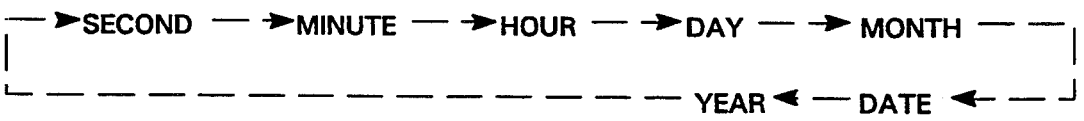
- DISPLAY AUTOMATICALLY RETURNS TO NORMAL TIME MODE IF LEFT UNUSED FOR 2 MINUTES.
- COLON IS FLASHING WHEN CHIME IS SET
FIG. 5

ALARM TIME MODE

S1: ALARM SET/RESET
S2: JUMP TO SETTING MODE
S3: JUMP TO NEXT MODE

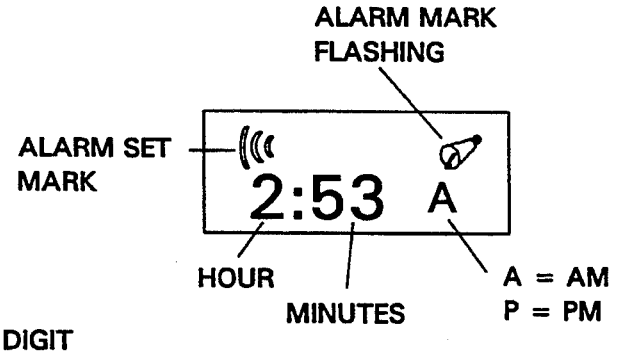

ALARM TIME SETTING MODE

S1: INCREMENT THE FLASHING DIGIT
S2: EXIT THE SETTING MODE
S3: SELECT THE FLASHING DIGIT

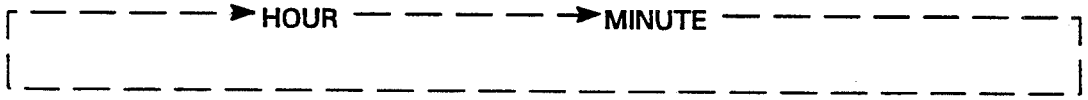

- DISPLAY AUTOMATICALLY RETURNS TO NORMAL TIME MODE IF LEFT UNUSED FOR 2 MINUTES.

FIG. 6

PROGRAM MODE

S1: SELECT NEXT RECORD
S2: JUMP TO SETTING MODE
S3: JUMP TO NEXT MODE

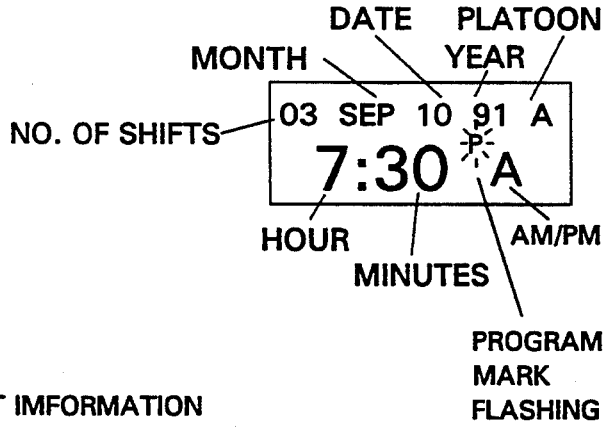

PROGRAM ENTERING MODE

S1: INCREMENT FLASHING DIGIT
S2: EXIT THE ENTERING MODE
S3: SELECT DIGIT
S4: PICK PLATOON
S1 & S4: LOCK PLATOON AND SHIFT IMFORMATION

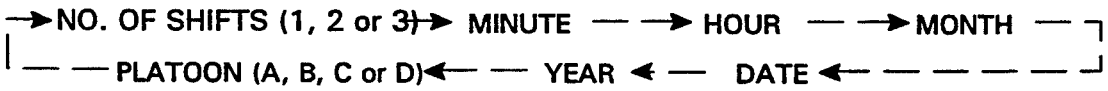

- DISPLAY AUTOMATICALLY RETURNS TO NORMAL TIME MODE IF LEFT UNUSED FOR 2 MINUTES
- MINUTE IS ADVANCED IN STEPS OF 30 MINUTES
- PROGRAM WILL BE SORTED AUTOMATICALLY BASED ON START DATE

FIG. 7

PLATOON MODE (CHECKING)

S2: JUMP TO PLATOON CHECKING MODE
S3: JUMP TO NEXT MODE

PLATOON CHECKING MODE

S1: INCREMENT FLASHING DIGIT
S2: EXIT THE CHECKING MODE
S3: SELECT DIGIT
S4: DECREMENT FLASHING DIGIT

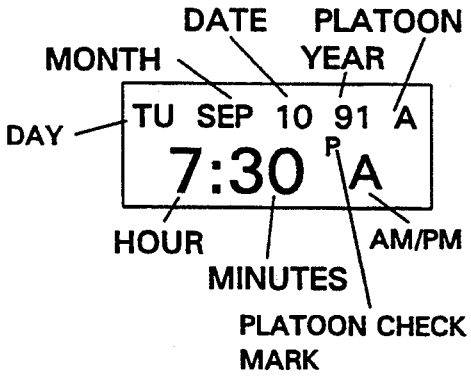

DATE → MONTH → HOUR → MINUTE → YEAR

- DISPLAY AUTOMATICALLY RETURNS TO NORMAL TIME MODE IF LEFT UNUSED FOR 2 MINUTES
- MINUTE IS ADVANCED IN STEP OF 30 MINUTES

FIG. 8

CHRONOGRAPH MODE

S1: START/STOP THE COUNTING
S3: JUMP TO THE NEXT MODE
S4: LAP/RESET THE COUNTING

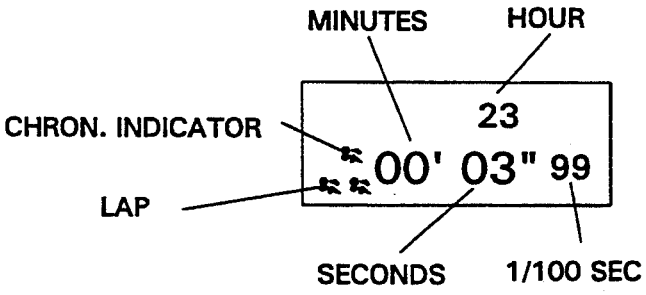

FIG. 9

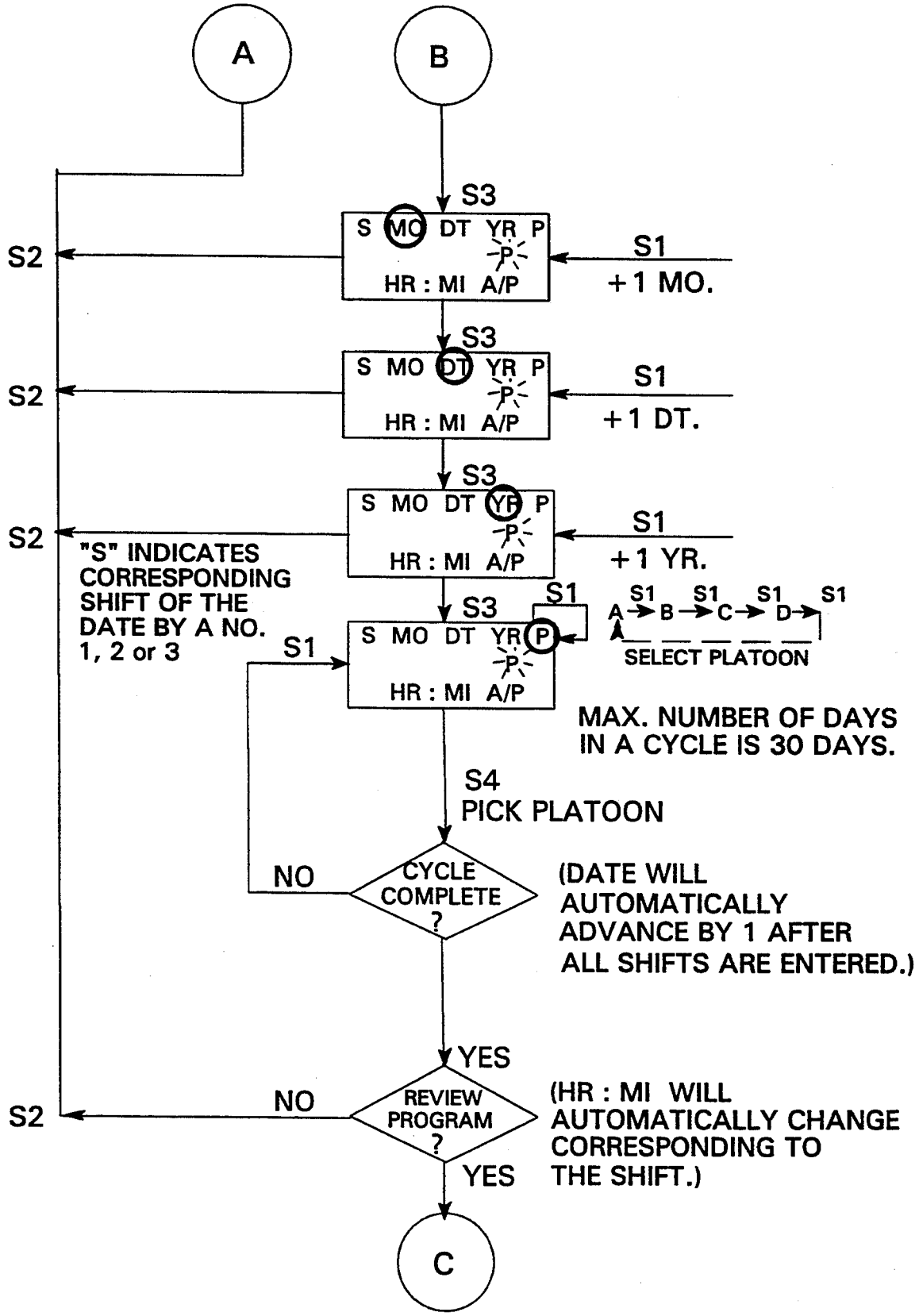
FIG. 14A (CONTD.)

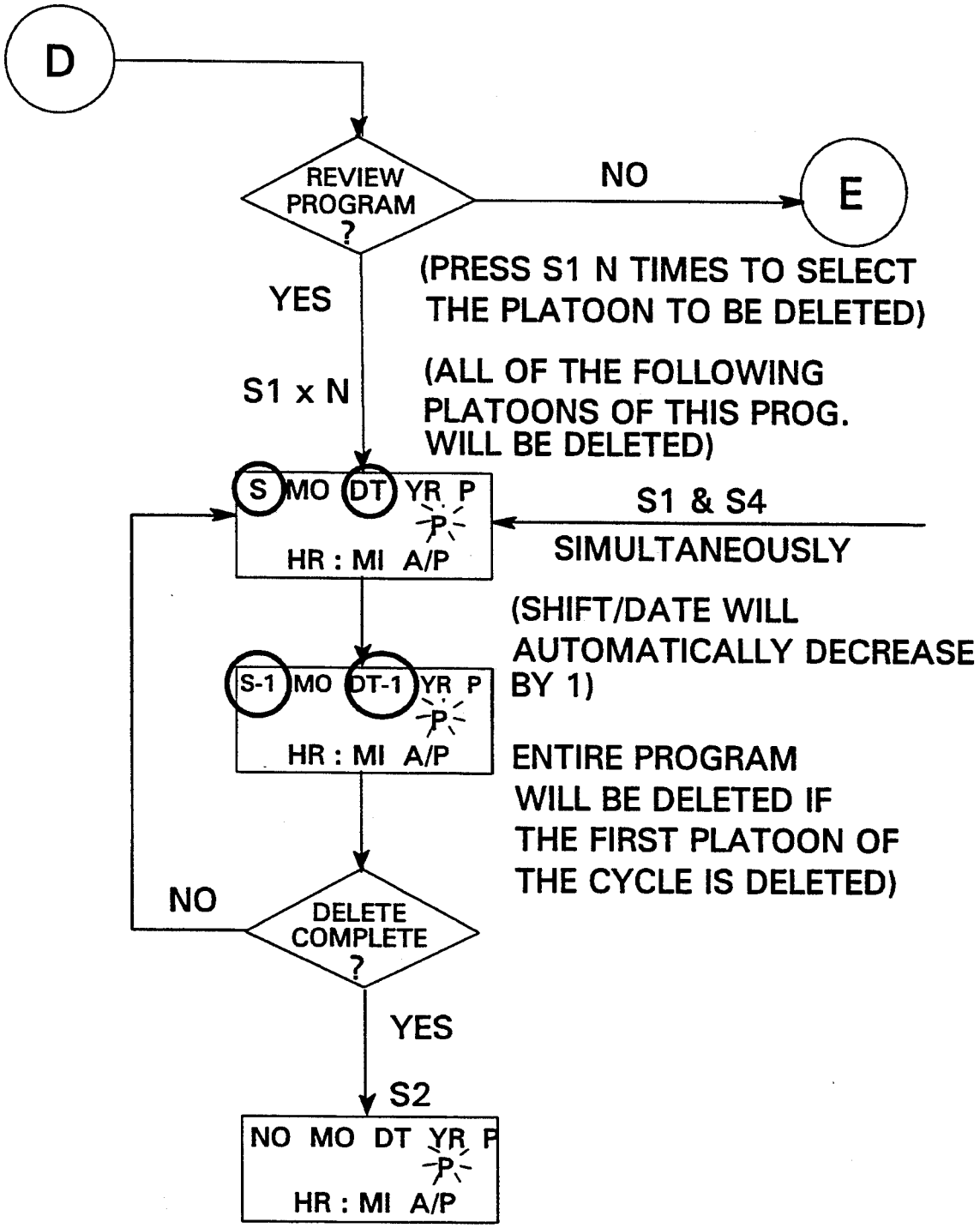
FIG. 14B (CONTD.)

PLATOON SCHEDULE WATCH AND METHOD OF PROVIDING A SCHEDULE FOR A USER OF SHIFT START TIMES BOTH PROSPECTIVE AND RETROSPECTIVE

BACKGROUND OF THE INVENTION

This invention relates to the fields of horology and electronic scheduling, and more specifically to an invention and a method which allows the user to enter, display, review, and modify specific cyclical shift or platoon scheduling data, besides allowing the normal functions of a digital wrist watch such as keeping track of the time, the date, and any alarms that the user sets.

There are many professions in which personnel work a cyclical shift schedule. These personnel include those in the fire fighter, medical, law enforcement, and security professions. The traditional method of keeping track of when a specific platoon (i.e., A, B, C or D) will be or is on duty or at work has required that a printed calendar containing the schedules be created and then copies made and distributed to all personnel. The personnel would then have to refer to this calendar for scheduling months or even years ahead. However, it is not always possible or practical for an individual to carry a calendar around with them, and they are constantly faced with the problem of knowing what shift they will be working or already have worked when a schedule calendar is not available.

Several patents have been granted for electronic time management schedulers and calendars. See, for example, U.S. Pat. Nos. 4,868,800; 4,774,697; 4,712,923; 4,769,796; 4,548,510; 4,534,012; 4,459,036; 4,415,271; 4,303,995; and 4,162,610. The embodiments of the 4,774,697 and 4,303,995 disclose the combination of the electronic time management schedulers with a wristwatch, and the 4,534,012 patent uses both a portable system (i.e., a wristwatch) and an external stationary station. These patents all allow the user to enter dates (and sometimes text with the date) that the user either wants to store for future reference or wishes to be reminded of when the entered dates arrive. None of these patents discloses a system that may be used to enter, display, review and modify cyclical shift or platoon schedule information without entering each and every date and time that each shift or platoon will be working. Therefore, any generalized scheduler is not useful for such platoon-type scheduling.

It is the object of this invention to provide a system that will allow an individual who needs to keep track of shift schedule information to enter, display, review and modify that information on a full-function wrist watch. The system allows the user to enter, display or modify scheduling information for two to four platoons or shifts, with a maximum of three shifts allowed in a given twenty-four hour period. The preferred vehicle for this invention will be an electronic digital timepiece using a digital liquid crystal display that employs programming logic sufficient to fulfill the aforementioned scheduling functions, while also including time and date display, a chronograph function, and an alarm clock with chime. It also is preferred that the timepiece be at least water resistant, particularly for firefighters.

These and other advantages and objects of this invention will become apparent from the following disclosure and appended claims.

SUMMARY OF THE INVENTION

There is disclosed herein a device that has the general appearance of an electronic digital timepiece or wristwatch. On the outer face there is one window employing well-known liquid crystal display (LCD) technology, commonly found in timepieces of the digital type. This window has sixteen (16) display rectangles for data presentation that display all of the functions of the device. Each display rectangle is divided into several segments. There are seven (7) segments used to display a number, and eight (8) segments to display an alpha character.

For example, the window displays real time following common practice for digital watches (i.e., hour:minute second or HH:MM ss). The time may be displayed in twelve (12) or twenty-four (24) hour format.

The window also displays the current date (or any other date selected by the user) in conventional U.S. format (i.e., a two letter abbreviation for day of the week, a three letter abbreviation for the month, date and year). For example, the window might display the date as "Fr Jan. 31" or "Fr Jan. 31 92."

The final digit used for data presentation displays the letter of the platoon that is currently on duty (i.e., A, B, C, or D) or that is on duty at the day and time selected by the user. The window also displays icons that represent various functions that the device performs, such as marks to indicate that the alarm has been set or that the alarm is going off, and three marks to indicate when the device is in chronograph or lap mode. The last mark is a flag symbol that is displayed when the user moves the date backwards or forwards to check which platoon is on duty. This mark also flashes when the user selects a program.

There are a number, i.e., four (4), selector buttons located on the outside edge of the timepiece for easy access. These buttons provide the following functions: (1) setting the device and starting and stopping a function, (2) controlling a function, (3) selecting a mode, and (4) starting or resetting the lap function. The buttons are in different locations and may be of varying sizes to allow tactile identification or color-coded to allow visual identification.

The circuitry accomplishing the results of this invention employs a common oscillator that is used to drive both the timing circuitry, a central processing unit (CPU), and display circuitry. The timing circuitry for the device constitutes well-known dividers, counters, and driving circuitry.

Information entered or edited by the user (such as schedule data) is stored in Random Access Memory (RAM). The actual programming information used by the device for the time, date, alarm, chronograph and scheduling functions is stored in Read Only Memory (ROM). A perpetual calendar good for approximately fifty (50) years is also stored in ROM.

The user enters shift schedule data into the device through the use of the various control buttons located on the device. These buttons also allow the user to review and/or modify any data already entered. The buttons further allow the user to enter, display, review and modify time and date information, and to start and stop the timer function.

The standard shift schedule is cyclical and based on two (2), three (3) or four (4) platoons or shifts. Typically, a cycle may be from two (2) to thirty (30) days long. The length of time that a platoon is on duty or at work is also variable, as is the number of platoons or shifts and the times that a platoon starts work. The programming logic of this device accounts for all these variables. The device allows for a work cycle to be between one (1) and twenty-four (24) hours long, and two to four platoons working a maximum of three shifts in any twenty-four hour period are contemplated.

A firefighter's work schedule may be used to illustrate the schedule function of the invention. In this example, there are four (4) platoons, designated as A, B, C, and D. Each platoon works ten (10) and fourteen (14) hour shifts on an eight (8) day repeating cycle. The schedule described above may be illustrated as follows:

| Start | 8 DAY REPEATING CYCLE | | | | | | | | | |
|---|---|---|---|---|---|---|---|---|---|---|
| | Date and Platoon | | | | | | | | | |
| of Shift | 1 | 2 | 3 | 4 | 5 | 6 | 7 | 8 | 9 | 10... |
| 8:00 a.m. | A | A | C | C | D | D | B | B | A | A... |
| 6:00 p.m. | B | B | A | A | C | C | D | D | B | B... |

The user enters the schedule information (including which platoon is on duty on what date and at what time) for all of the platoons. This schedule information is entered only for one cycle, but an entire cycle must be entered, and then the device will calculate the rest of the schedule as far into the future as the available memory allows. Thus, the user may look ahead to the future to see which platoon is on duty on any particular date at any particular time, or may look back to past dates to see which platoon was on duty. Shifting the date to view past or future dates and scheduling information does not change the current date or time.

In the preferred embodiment, the device or method supports one (1) past record. This record set supports a maximum of four (4) platoons or shifts, with a maximum of three (3) shifts per day during any twenty-four hour period. The minutes in the scheduling program should be in steps of thirty (30) minutes (i.e., the user may only set a shift start time on the hour or on the half hour). The schedule information entered by the user is sorted automatically based on the start date, so the user may enter this information in any order.

The preferred embodiment of the invention is a wrist watch water resistant to fifty (50) meters, in a metal case with a plastic jacket outside, normal time keeping functions, and a platoon and shift function that can be programmed from the present year through fifty (50) or more years. The preferred embodiment also includes a chime function set to beep every hour (which may be disabled), an alarm function with buzzer signal output, and auto calculation of leap year and day of the week. It may also be programmed to give an alarm at a predetermined time.

DESCRIPTION OF THE DRAWINGS

This invention may be more clearly understood from the following detailed description and by reference to the drawing in which:

FIG. 2 is a detailed window drawing;

FIG. 5 is a mode operation summary, display and flow cycle of the invention in normal time and normal time setting mode;

FIG. 6 is a mode operation summary, display and flow cycle of the invention in alarm time and alarm setting mode;

FIG. 7 is a mode operation summary, display and flow cycle of the invention in platoon setting program mode;

FIG. 8 is a mode operation summary, display and flow cycle of the invention in platoon checking mode;

FIG. 9 is a mode operation summary, and display of the chronograph mode, including icons;

DESCRIPTION OF THE PREFERRED EMBODIMENT

Figure 1:
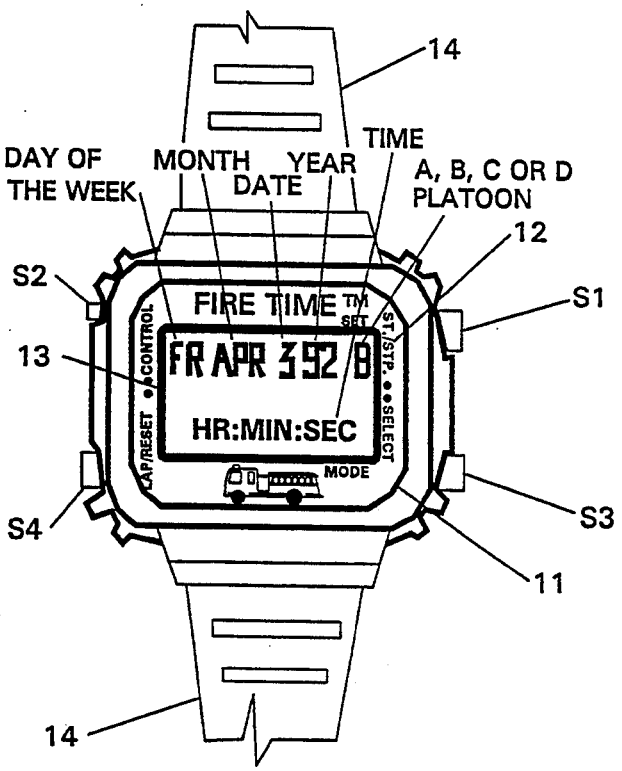
FIG. 1 is a front elevational view of a wrist watch, including a partial band, incorporating this invention.

In its preferred embodiment, this invention is embodied in a combination wristwatch and electronic shift scheduler in the form best seen in FIG. 1. There, the combination of this invention is all enclosed within a watch-type case 11 having a front face region 12 with a rectangular window 13. The combination is held on the wearer's body by a pair of straps 14 which may be ordinary watch straps. However, in the preferred embodiment of this invention the straps are made of flexible plastic.

The window 13, seen more completely in FIG. 2, contains display means, for example, LED, liquid crystal, or other type of visual display commonly used in digital watches. In the preferred embodiment, the window 13 has sixteen (16) digit displays. The functions preferred to be displayed at all times, or on demand, if not in Normal Time Mode, include:

Date—a two letter abbreviation for day of the week 15 and 16, a three letter abbreviation for the month 20, 21, and 22, date 23 and 24, and a two digit abbreviation for the year 25 and 26.

Hours 31 and 32, Minutes 33 and 34, and AM/PM 35 and 36.

Platoon Indicia 30

See FIG. 5 for an illustration of the window 30 as it appears to the user in the Normal Time Mode.

In FIG. 1, the time is registered in the window 13 where the drawing shows HR:MIN:SEC, plus A or P to designate either AM or PM, while the date is registered as Tu Mar 26. The platoon on duty on that date, at that time, is displayed in the upper right hand corner of the screen as A.

Figure 3:
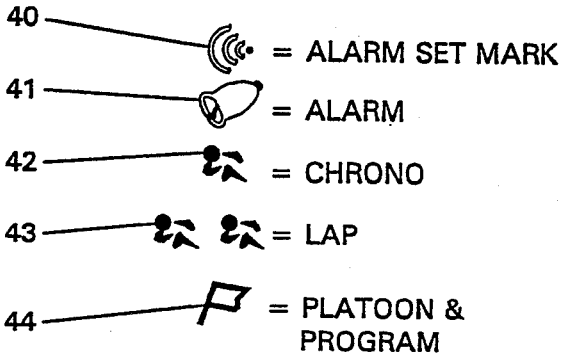
FIG. 3 is a series of screen icons and explanation thereof.

Illustrated in FIGS. 2 and 3 are the icons displayed in the window 13 of the device. These icons represent various functions that the watch performs as illustrated in FIG. 2. These include icons to indicate that the alarm has been set 40 or that the alarm on 41, and three icons to indicate the chronograph mode 42 or lap mode 43. The last icon 44, a flag, is displayed when the user moves the date backwards or forwards to check on which platoon is on duty on a particular date and time.

This icon 44 also flashes when the user is in the programming mode.

Figure 1A:
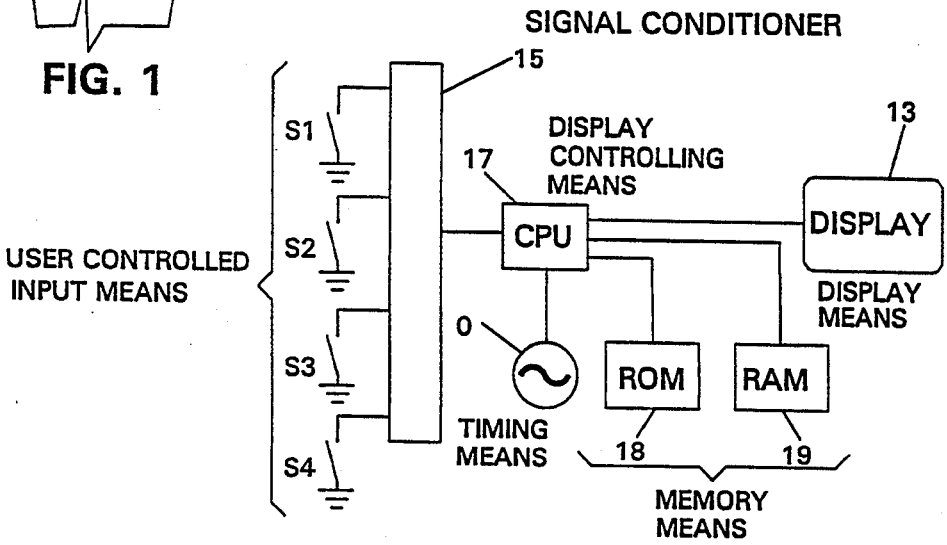
FIG. 1A is a block diagram of the basic process components of the watch of this invention and their primary connections to programming and physical resources.
Figure 4:
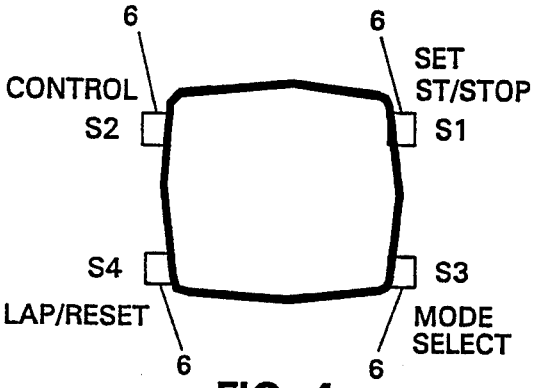
FIG. 4 is an outline of the watch face showing the four labeled buttons.

The combination of this invention preferably includes four switch controls, S1, S2, S3 and S4, as illustrated in FIGS. 1, 1A, and 4, and described below:

| Switch | Name | Mode | Functions |
|---|---|---|---|
| (S1) | Set, start and stop | Normal | Sound check, chime set and reset, increment flashing digit (repeating cycle = second, minute, hour, day, month, date, year, SEE FIG. 5) |
| | | Alarm | Alarm set and reset, increment flashing digit (repeating cycle = hour, minute, SEE FIG. 6) |
| | | Program | Select next record, increment flashing digit (repeating cycle = number of shifts, minute, hour, month, date, year, platoon, SEE FIG. 7), delete platoon (must press S1 and S4 simultaneously) |
| | | Platoon | Increment flashing digit (repeating cycle = date, month, hour, minute, year, SEE FIG. 8) |
| | | Timer | Start and stop the counting |
| ** Holding S1 down will cause the selected digit to increment automatically. | | | |
| (S2) | Control | Normal | Enter and exit setting mode |
| | | Alarm | Enter and exit setting mode |
| | | Program | Enter and exit setting and entering modes |
| | | Platoon | Enter and exit platoon checking mode |
| | | Timer | NO FUNCTION |
| (S3) | Mode select | Normal | Enter next mode, select the flashing digit |
| | | Alarm | Enter next mode, select the flashing digit |
| | | Program | Enter next mode, select digit |
| | | Platoon | Enter next mode, select digit |
| | | Timer | Enter next mode |
| (S4) | Lap and Reset | Normal | Select 12/24 hour display, |
| | | Alarm | NO FUNCTION |
| | | Program | Select prior record, pick platoon, delete platoon (must press S1 and S4 simultaneously) |
| | | Platoon | Decrement flashing digit |
| | | Timer | Lap/reset the counting |
| ** Holding S4 down in Platoon Checking Mode will cause the selected digit to decrement automatically. | | | |

FIG. 1A illustrates the classic computer architecture employed in this invention. Switches S1–S4 are connected to a signal conditioner 15 for encoding each switch closure to be input into CPU 17 which generates the required signals for the display 13 after reference to the calendar information stored in the ROM 18 and the user input information in the RAM 19. The CPU makes the calculations required for the operation of this invention, for example, the division of the twenty-four (24) hour day into the number of shifts as designated by the user. It also calculates the repeating cycle of the schedule and applies it to the calendar information both prospective and retrospective to determine the platoon assignment for each time interval and its start time. The signal conditioner 15, CPU 17, Oscillator O, ROM 18, and RAM 19 are all on a single chip in conventional digital watch technology.

The Oscillator O constitutes the watch's timing means. The ROM 18 and RAM 19 constitute the invention's memory means. The LCD display 13 is the device's display means. The CPU 17 is both the display controlling means and the means for calculation. Switches S1 through S4 are user controlled inputting means and allow the input of user selected information into the memory means. The preferred embodiment is to use four switches for this inputting means, but more switches, each dedicated to a particular type of input, could be used.

The basic watch used in this invention is the Paragon Electronic Co., Ltd., Model No. DL8856. The microcontroller is the SMC6235 (Epson), the circuit board is identified as DL-57, and one of the capacitors is identified as C1L. The watch features three (3) volt battery operation, 32.768 KHz crystal oscillation, and a three (3) volt, $\frac{1}{3}$ bias, $\frac{1}{4}$ duty LCD display.

FIG. 5 is an illustration of the invention in the normal time mode, which incorporates all icons displayed while in this mode, including the designated platoon on duty at that time, namely Platoon A. The repeating cycle of selectable digits of this mode is also illustrated, as is the function of each switch while in this mode.

FIG. 6 is an illustration of the invention in the alarm time mode, including icons displayed while in this mode. The repeating cycle of selectable digits of this mode is also illustrated, as is the function of each switch while in this mode.

FIG. 7 is an illustration of the invention in the program mode and program entering mode, including all icons displayed while in this mode. The program mode is identified by the flashing flag. The repeating cycle of selectable digits of this mode is also illustrated, as is the function of each switch while in this mode.

FIG. 8 is an illustration of the invention in platoon checking mode, including all icons displayed in this mode. This mode is characterized by the date being the user selected date and time, not the current date and time. The repeating cycle of selectable digits of this mode is also illustrated, as is the function of each switch while in this mode.

The timer or chronograph function illustrated in FIG. 9 is particularly useful in those professions in which measurements of elapsed time are required (such as the medical profession, which requires, for example, that a patient's pulse be timed). The timer function employs the accurate timing circuitry of the watch and uses its display as well. Elapsed time is displayed in hours, minutes, seconds, and hundredths (1/100) of a second. See generally FIG. 9 for an illustration of the timer function in action. The repeating cycle of selectable digits of this mode is also illustrated, as is the function of each switch while in this mode.

1. General Overview of the Functions

This watch has five functions, namely:

1. Timekeeping with 12 hour AM and PM or 24 hour display;
2. Alarm setting and operation;
3. Programmable shift scheduling;
4. Shift searching, past or future; and
5. Chronograph (stop watch).

Figure 10:
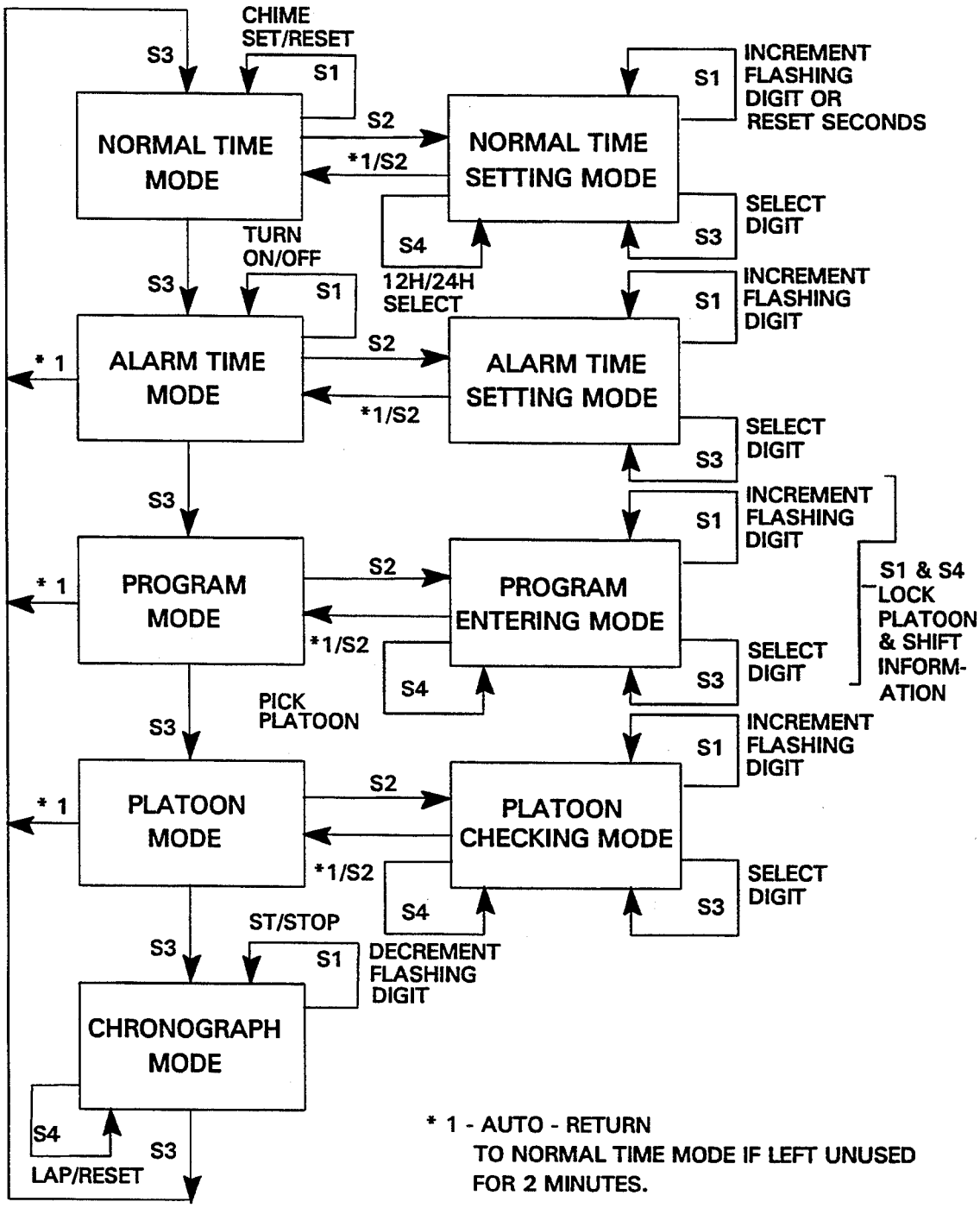
FIG. 10 is an operational block diagram of this invention.
Figure 11:
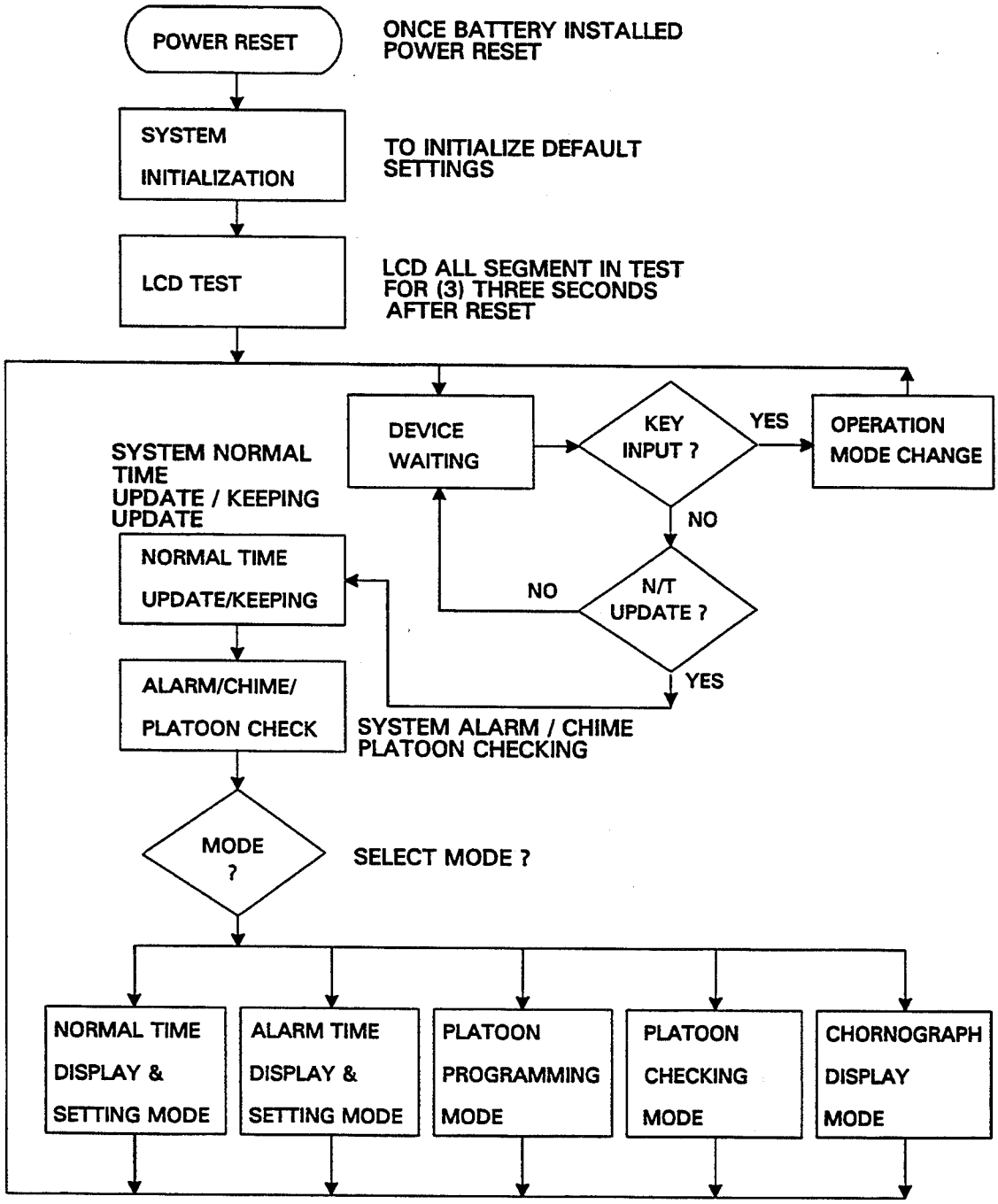
FIG. 11 is a simplified block diagram of the startup and overall operation of this invention.

The timekeeping, alarm and chronograph functions are consistent with previous digital watches with the exception that the display of time and date information is accompanied by display of the current platoon on duty. All of the functions of the preferred embodiment of this invention are illustrated in the operational block diagram of FIG. 10. A system logic view of the functions is provided in FIG. 11.

a. Clock and Alarm Operation

In Normal Time Mode, the user presses Switch S1 of FIG. 4 to turn the chime function on or off. The colon between the hour and minute digits will flash continuously if the chime function is on. The chime then will sound with the passing of every hour.

If Switch S2 is pressed while in Normal Time Mode, the program changes to Normal Time Setting Mode. See generally FIG. 12. The seconds digits will flash continuously. By pressing Switch S3 while in Normal Time Setting Mode, the user is allowed to select which digit to change. Thus, the current minutes, hours, month, date and year may be changed. Pressing Switch S1 while in this mode allows the user to increment the digit that is flashing by one digit for every press of Switch S1. Pressing Switch S1 while the seconds digits are flashing will cause the seconds to reset to zero. If Switch S4 is pressed while in Normal Time Setting Mode, the program toggles between twelve (12) and twenty-four (24) hour display modes (i.e., from standard time to military time). The program will automatically return the display to the Normal Time Mode from the Normal Time Setting Mode if no buttons are pressed for a period of two minutes. Pressing Switch S2 also will return the display to the Normal Time Mode from the Normal Time Setting Mode.

Switch S3 is pressed while in Normal Time Mode to enter Alarm Time Mode. The display will clear and show only the time the alarm is set to go off an the alarm and alarm set icons. The alarm will sound for twenty (20) seconds at the preprogrammed time. Pressing Switch S1 while in this mode allows the user to turn the alarm on or off.

If Switch S2 is pressed while in Alarm Time Mode, the program switches to Alarm Time Setting Mode. The minutes digit will begin to flash continuously. Pressing S1 while in Alarm Time Setting Mode allows the user to increment the digit that is flashing by one digit for every press of Switch S1. Holding down Switch S1 will cause the digit to increment automatically. By pressing Switch S3 while in Alarm Time Setting Mode, the user is allowed to select which digit to change (i.e., the hours or the minutes). Thus, the time of the alarm may be changed. The alarm may not be set for a time farther away than twenty-four (24) hours from the current time. Pressing Switch S2 will return the display to the Alarm Time Mode from the Alarm Time Setting Mode. Pressing Switch S3 will return the display to the Normal Time Mode.

b. Program Mode

Switch S3 is pressed while in Alarm Time Mode to enter Program Mode. The flag symbol will flash continuously and the platoon indicia is displayed in the upper right hand corner of the display screen.

If Switch S2 is pressed while in Program Mode, the program switches to Program Entering Mode. By pressing Switch S3 while in Program Entering Mode, the user is allowed to select which digit to change. Pressing S1 while in Program Entering Mode allows the user to increment the digit that is flashing by one digit for every press of Switch S1 or to automatically increment the digit by holding S1 in. Thus, a particular shift's start time and date of duty may be entered and changed. Pressing Switch S4 while in Program Entering Mode allows the user to pick which platoon (i.e., A, B, C, or D) is on duty at the user selected time and date (i.e., this locks in the day, shift time and platoon and moves to the next shift). Pressing both Switch S1 and Switch S4 simultaneously allows the user to delete the shift that is displayed. A complete cycle of schedule information must be entered before returning to the Program Entering Mode. Pressing Switch S2 will return the display to the Program Mode from the Program Entering Mode. See Section 2, below, for a more complete description of the Program Mode.

If Switch S3 is pressed while in Program Mode, the program will enter Platoon Mode. The program will automatically display the shift schedule for the current date and time. The flag icon will not flash.

Pressing Switch S2 while in Platoon Mode causes the program to enter Platoon Checking Mode. This mode allows the user to check what platoons or shifts are on duty on a particular day at a particular time. By pressing Switch S3 while in Platoon Checking Mode, the user is allowed to select which digit to change. Pressing S1 while in Platoon Checking Mode allows the user to increment the digit that is flashing by one digit for every press of Switch S1. Pressing Switch S4 while in Platoon Checking Mode decrements the digit that is flashing by one digit for every press of Switch S4. Thus, the time, date and shift number may be changed. Pressing Switch S2 will return the display to the Platoon Mode from the Platoon Checking Mode. Pressing Switch S3 twice will return the display to the Normal Time Mode. See Section 3, below, for a more complete description of the Platoon Checking Mode.

c. Chronograph Mode

Pressing Switch S3 while in Platoon Mode causes the program to enter Chronograph Mode. Pressing Switch S1 while in this mode starts or stops the timer, and pressing Switch S4 sets the lap time or resets the time, depending on whether the timer is currently running. Pressing S3 while in the Chronograph Mode returns the program to the beginning of the watch's display cycle, Normal Time Mode. The stop watch continues to run while in Normal Time Mode.

2. Schedule Entering Process

FIGS. 14A through 14D are flow diagrams illustrating the process whereby the user enters and edits shift scheduling information. These figures represent the actions taken by the user (i.e., the user's interaction with the device), and the device's displayed responses. An explanation given below represents the actual logic or functions taken by the device's programming in response to user input or interaction.

Figure 14A:
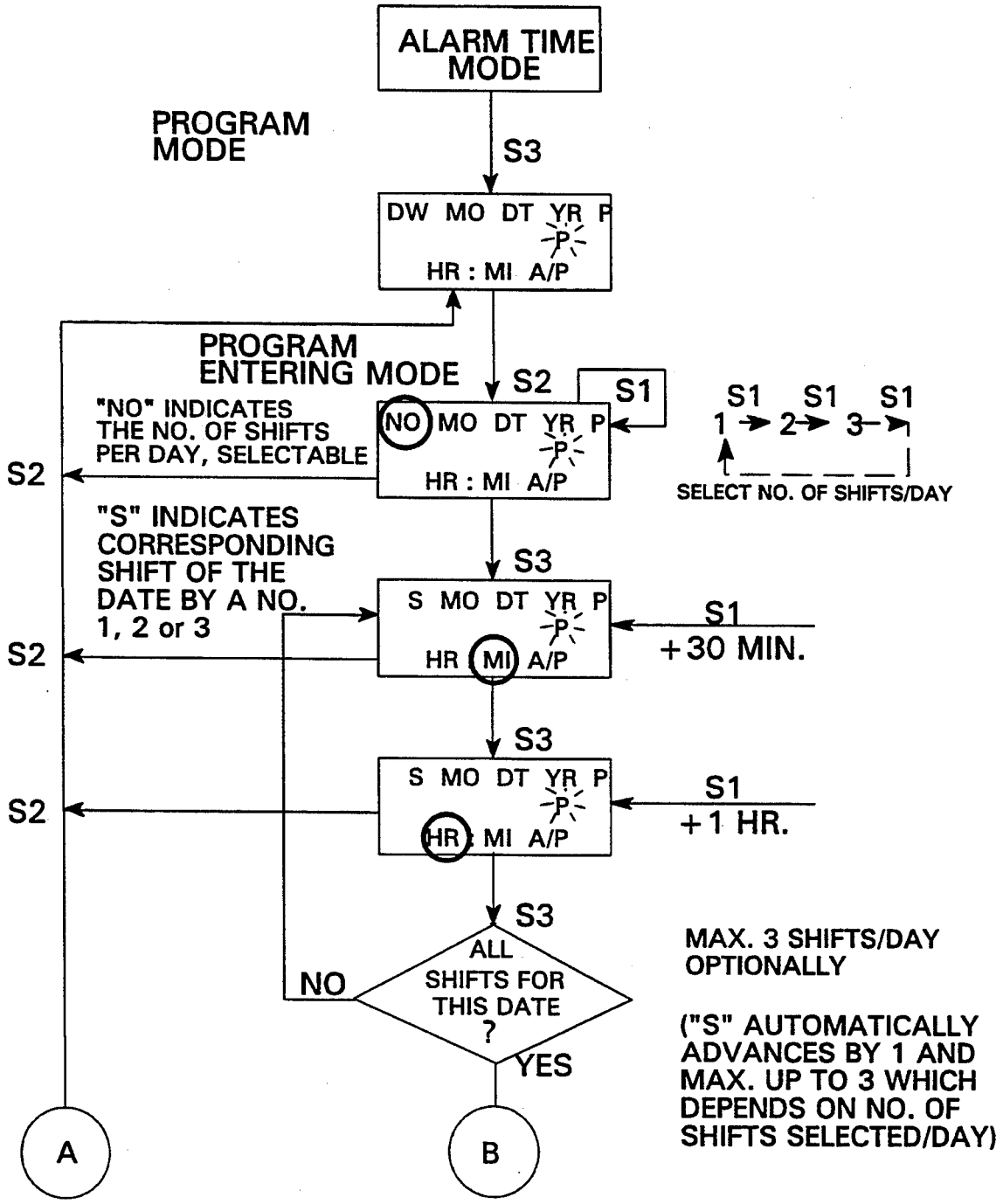
FIGS. 14A–D is a flow chart of the platoon programming operation of this invention.

As FIG. 14A illustrates, the user starts in Normal Time Mode and presses the correct buttons to enter Program Mode (i.e., press Switch S3 twice). Next, Switch S2 is pressed to enter the Program Entering Mode, where the user may enter or edit the shift schedule for a particular date. The flag symbol flashes continuously. The user will be allowed to select the number of shifts per day, and then to enter the hour and minute (in thirty minute increments) that each shift starts, the month, day and year of the shifts, and the platoon assigned to each particular shift. See generally, FIGS. 14A and 14B.

The first thing the user does is to select the number of shifts on this date. FIG. 14A. Switch S1 is pressed repeatedly until the proper number of shifts is selected (from 1 to 3). For example, if there are two (2) shifts working on this date, then Switch S1 would be pressed twice. A maximum of three shifts per twenty-four hour period is allowed.

Next, the user must enter the start time of this shift. FIG. 14A. Switch S3 is pressed to select the next digit to be changed, the minute digit. Repeatedly pressing Switch S1 allows the user to toggle the minute digit between "00" and "30" until the proper number is reached. For example, if the first shift begins work at 8:00 a.m., then this digit would be set to "00." If the shift begins work at 8:30 a.m., this digit would be set to "30." This digit may only be set in thirty (30) minute increments. Once the shift's start minute time has been entered, the user presses Switch S3 to select the next digit to be changed, the hour digit. This digit represents the hour that the shift begins work. Switch S1 is pressed repeatedly until the correct shift start hour is reached. The hour digit may only be advanced in one (1) hour increments.

After the start time for one of the shifts of the day has been entered (assuming there is more than one shift on this day), the program automatically advances the corresponding shift of the day (i.e., 1, 2 or 3) by one (1). FIG. 14A. For example, if there are two shifts working on this day, the user will first need to enter schedule information for the first shift, and then for the second shift. Therefore, the program will set the shift digit to "1" until the schedule information for the first shift has been entered. Then the program will automatically advance the shift digit to "2" so that the schedule information for the second shift may be entered. After the program has automatically advanced the shift digit to the correct corresponding shift of the day, the user may enter the next shift's start time as described above. FIG. 14A.

After the user has entered the start times (minute and hour) for all shifts of the day, the next step is to enter the duty date for these shifts. This is done by pressing Switch S3 to select the month digit, and then repeatedly pressing Switch S1 until the desired month is selected. FIG. 14A. The month digit may only be advanced in one (1) month increments. Next, the user presses Switch S3 to select the date digit, and then repeatedly presses Switch S1 until the desired numerical date is reached. The date digit may only be advanced in one (1) day increments. The last step to take in setting the shift date is to press Switch S3 to select the year digit, and then repeatedly press Switch S1 until the proper year is selected. The year digit may only be advanced in one (1) year increments, with a typical range from 92 (i.e., 1992) to 49 (i.e., 2049).

The final step to be taken to enter shift schedule information is to determine which platoons correspond to which shifts (i.e., in a situation where there are three shifts for one day, does shift 1 correspond to platoon A, B, C or D). To do this, the user presses Switch S3 to select the platoon digit, and then repeatedly presses Switch S1 until the proper platoon is selected. The proper platoon is the platoon that is on duty starting at the time displayed in the window 13. Switch S4 is pressed to select the displayed platoon as the corresponding platoon of the date. If there is more than one shift for the date in question, after the first platoon has been selected the program automatically changes the start hour and minute displayed corresponding to the shift displayed. In this case, the user continues to select platoons corresponding to the shift start times until all platoons and start times have been entered. Once this is done and the shift cycle is complete, the program automatically increments the date by one day.

After a complete cycle of schedule information has been entered, the user continues to enter shift scheduling information until all of the shifts for the cycle have been entered. The program will automatically increment the date by one day after each day's shifts have been entered.

The user has the option of either returning to the Program Mode by pressing Switch S2 (which will also set the cycle information into the watch's calendar memory), or reviewing the entered schedule information by pressing Switch S3.

Figure 14B:
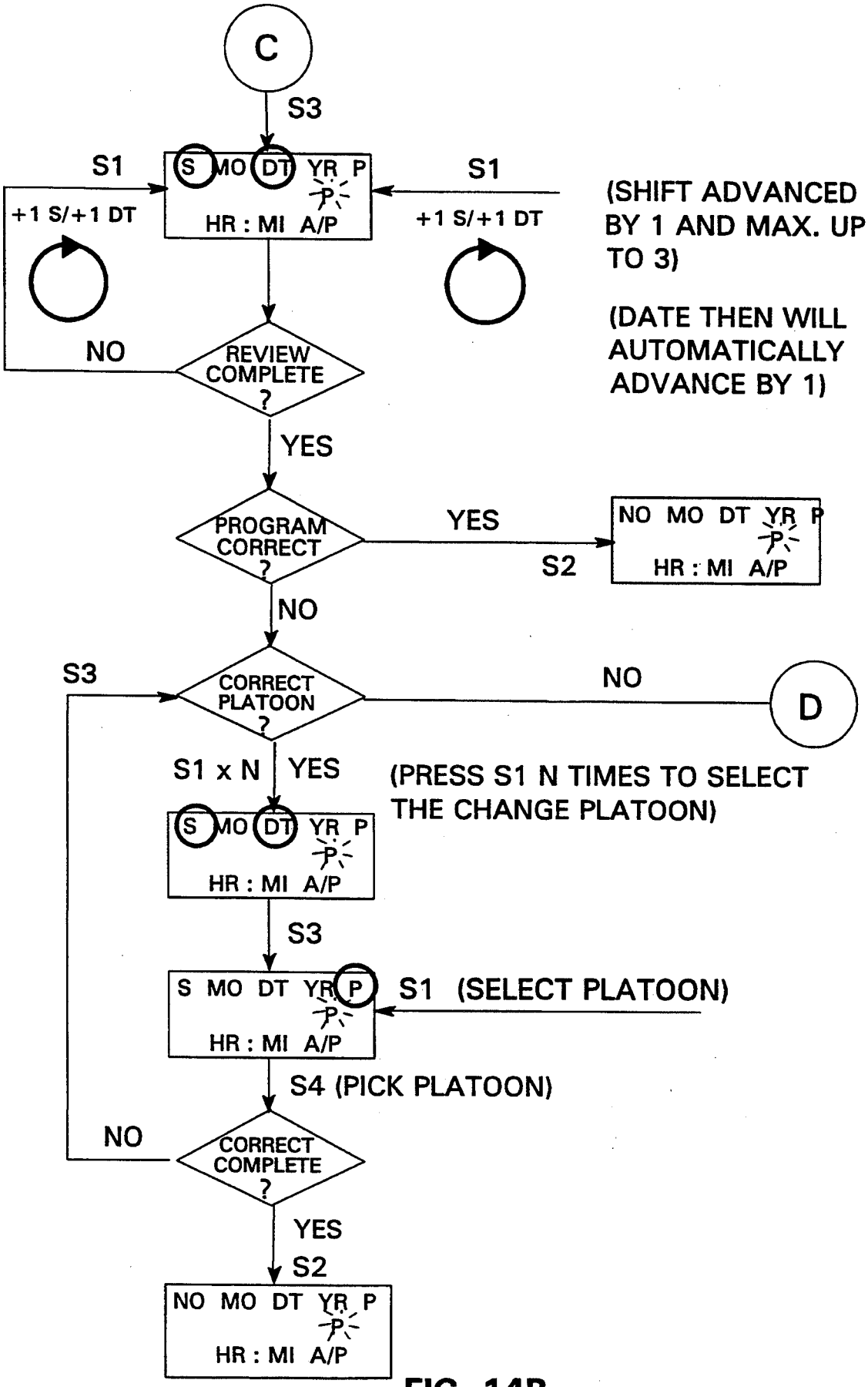

The first step in the reviewing process is to display the start date and time for each shift entered. The first shift for the first start date and time entered will automatically be displayed. FIG. 14B. If the user presses Switch S1 at this point, the shift number digit will be incremented by one, and the date and time for the next shift will be displayed. This process is repeated until all of the shifts for the date have been displayed. Once all of the shifts for the day have been reviewed, the user presses Switch S1 to increment the date by one day. The aforementioned review cycle is repeated until the user has completed the review of the entire schedule cycle.

Figure 14C:
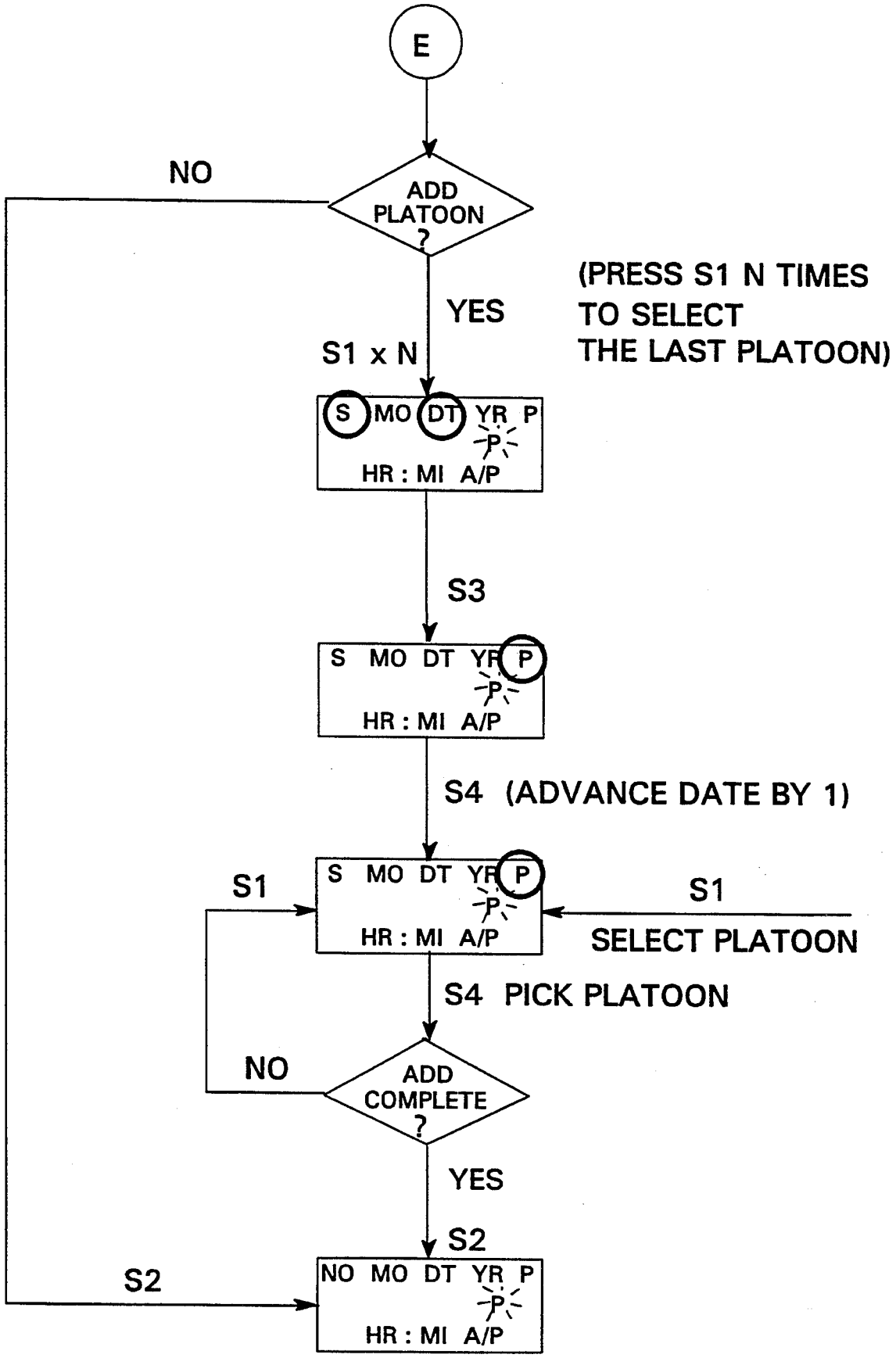

At this point, based on the review, the user must determine if the entered schedule information is correct. If it is, then Switch S2 may be pressed to return to the Program Entering Mode. If the information is not correct, the user may initiate the correction process. FIGS. 14B and 14C.

The first data that may be corrected is the platoon. If a selected platoon needs to be corrected, the user repeatedly presses Switch S1 until the correct shift is displayed. FIG. 14B. Next, the user presses S3 to select the platoon digit, and then repeatedly presses Switch S1 until the proper new platoon letter is selected. Switch S4 is pressed to enter the selected platoon indicia. Once the platoon correction has been made, the user may press Switch S2 to return to the Program Entering Mode.

If the user chose not to correct the platoon, then the user may choose to delete an entire shift from memory (i.e., if an entire shift has been incorrectly entered). To do this while in the Program Entering Mode, Switch S1 is pressed repeatedly until the shift to be deleted is displayed. FIG. 14B. Next, Switch S1 and Switch S4 are pressed simultaneously to delete the selected shift. The program automatically decreases the shift and date displayed by one shift and one day after a shift is deleted. If the user chooses to delete an entire shift from memory and that shift is not the last shift of the cycle, all shifts and platoons that follow will be deleted. If the user deletes the first platoon of a cycle, the entire cycle will be deleted. The user may continue to delete shifts, or may press S2 to return to the Program Entering Mode.

If the user chose not to correct the platoon, and not to delete an entire shift, it may be because the change the user wishes to make is to add a new platoon (rather than deleting anything). See generally FIG. 14C. If the user does not wish to add a new platoon, Switch S2 may be pressed to return the user to the Program Entering Mode.

To add a new platoon from the point represented as "B" on FIG. 14C, the user would repeatedly press Switch S1 until the last shift in the cycle is displayed. After the last shift is displayed, Switch S3 is pressed to select the platoon digit. The program automatically advances the date by one day after the platoon digit has been selected and Switch S4 has been pressed. Next, S1 is pressed repeatedly to select the new platoon (i.e., A, B, C or D), and this process is repeated until the user is finished adding new platoons. The user may then press Switch S2 to return to the Program Entering Mode.

Once the shift schedule cycle information for one complete cycle has been entered by the user, and the program has stored this in its memory (RAM), the program simply repeats that cycle for the remaining calendar dates in memory (ROM). In other words, the user's cycle is used like a template and is overlaid on the calendar dates remaining in the program's static memory.

Figure 12:
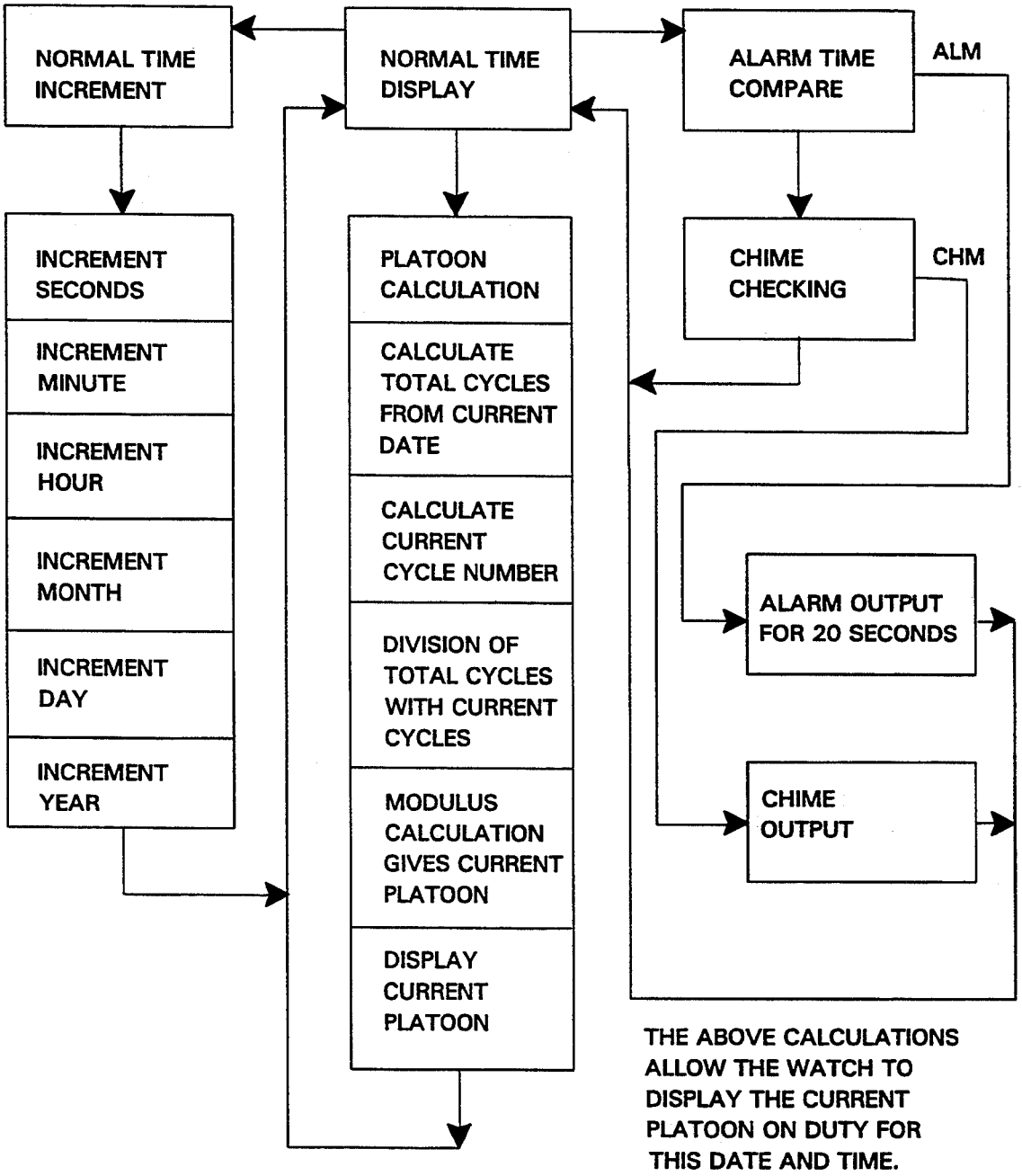
FIG. 12 is a simplified block diagram of the normal timekeeping and display operation of this invention.

FIG. 12 is a flow chart of the invention in normal time keeping and display operation. As the diagram illustrates, once the schedule information has been entered the watch will display the platoon currently on duty in conjunction with the display of the current time and date. As the current time and date change, the program will update the platoon on duty, ensuring that the correct platoon for the particular current time and date is displayed.

3. Platoon Checking Process

Figure 14D:
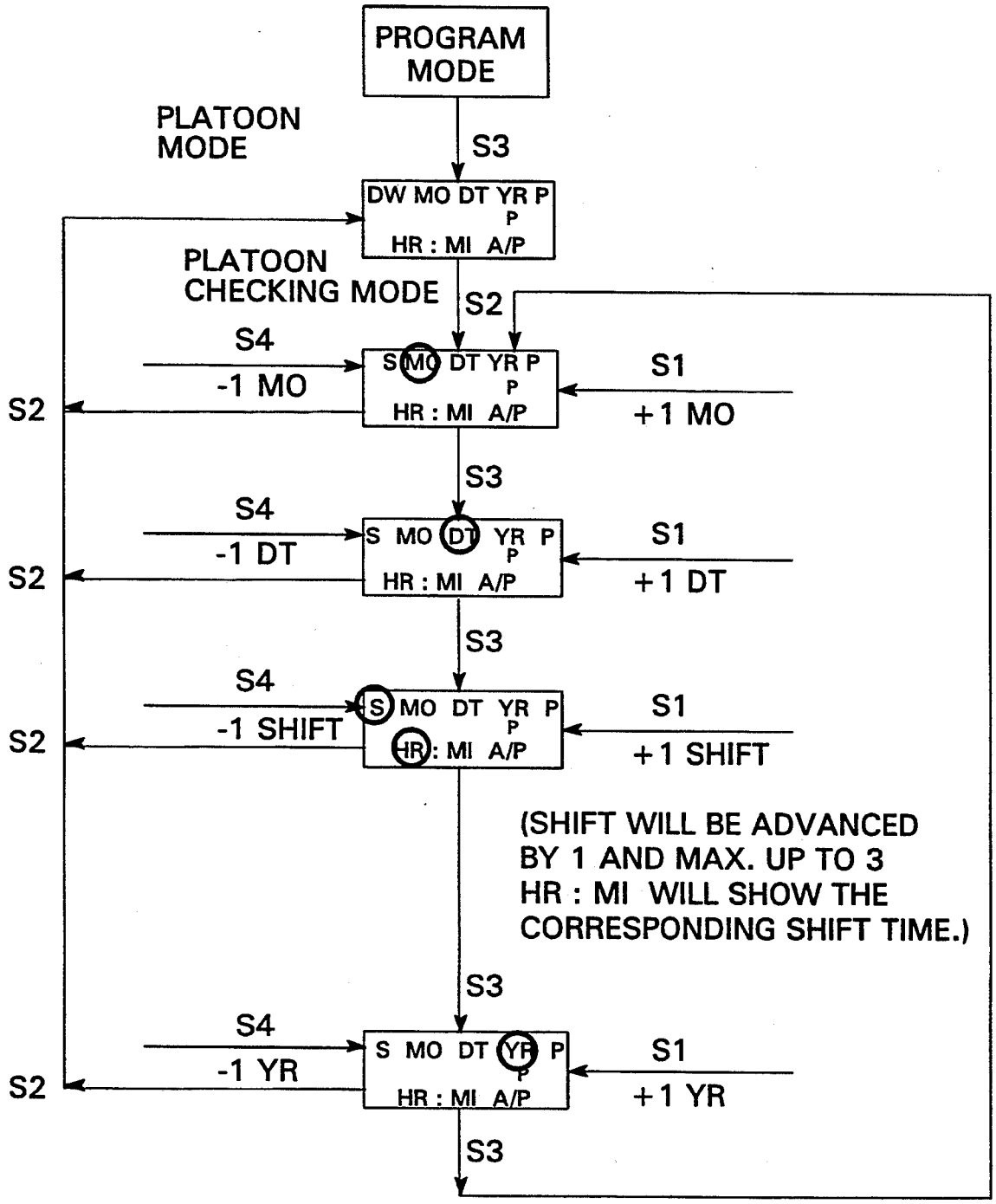
Figure 15:
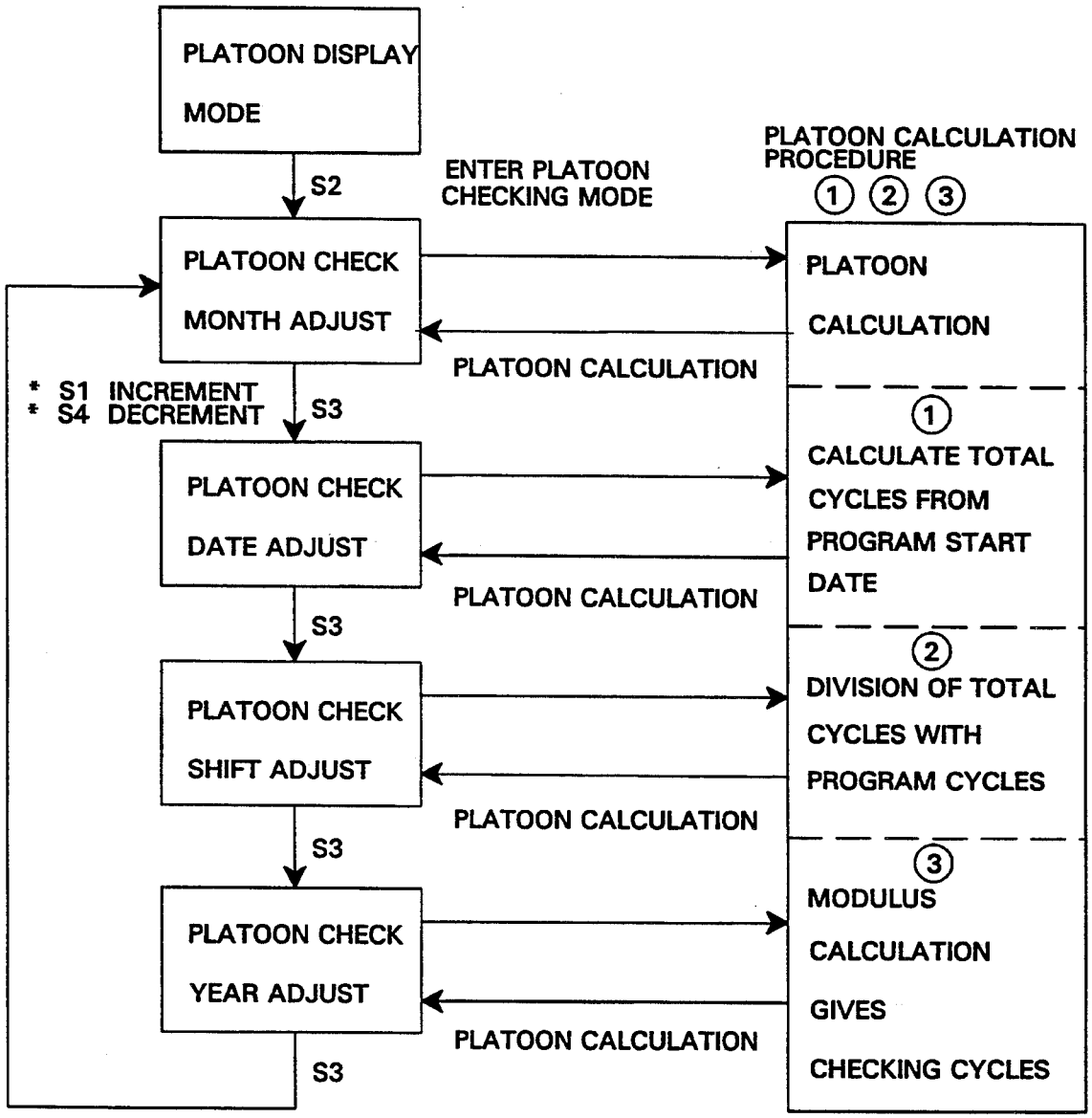
FIG. 15 is a platoon checking flow diagram.

FIG. 14D illustrates the platoon checking or review process. This figure only represents the actions taken by the user and the program's display response to those actions, and does not represent the actual program logic. FIG. 15, explained below, should be consulted to understand the actual program logic.

As FIG. 14D generally illustrates, the user must repeatedly press Switch S3 from the Normal Time Mode Display until the Platoon Mode is entered (i.e., press Switch S3 three times). Next, Switch S2 is pressed to enter the Platoon Checking Mode. The first thing the program allows the user to do is to change the date and time, starting with the month and followed by the day, the start hour, and the year.

The month may be incremented by one (1) month by repeatedly pressing Switch S1, or may be decremented by one (1) month by repeatedly pressing Switch S4. If the correct month is displayed, Switch S3 is pressed to allow the user to display the desired day corresponding to the month already selected. The day may be incremented by one (1) day by repeatedly pressing Switch S1, or by holding in rapid increment, may be decremented by one (1) day by repeatedly pressing Switch S4, or by holding in rapid increment. Once the correct month and day have been selected, the user presses Switch S3 to select the shift number digit. The shift number digit may be incremented by one (1) by repeatedly pressing Switch S1, or may be decremented by one (1) by repeatedly :pressing Switch S4. The shift start hour and minute, and the correct platoon indicia corresponding to the chosen shift number, month and day will be displayed.

Switch S3 is pressed to allow the user to change the year corresponding to the day, month, hour and shift already selected. The year may be incremented by one (1) year by repeatedly pressing Switch S1, or may be decremented by one (1) year by repeatedly pressing Switch S4. After the review is complete, the user will be returned to the start of the platoon checking cycle. Pressing Switch S2 once and then Switch S3 twice will return the user to the Normal Time Mode. The user may restart the platoon review process by pressing Switch S2 any time.

FIG. 15 gives an overview of the actual program logic involved in the platoon checking process. Once the user is in Platoon Checking Mode and selects the month and day to be checked, the program beings its calculations. First, the program calculates the total number of cycles possible (depending upon the device's remaining calendar memory size) using the program's start date (i.e., the first date of the cycle originally entered by the user). This calculation may be performed in a number of ways. One way would be to divide the number of days remaining in the calendar's memory (from the first day of the cycle entered by the user) by the length of the cycle (i.e., if the user entered eight days worth of shift schedule information, the cycle length would be eight). The product of this calculation would be the total number of cycles from the user's programmed start date.

After the user selects which shift number is to be displayed for the chosen date, the program would divide the total number of cycles from the user's programmed start date by the program cycles to calculate the current cycle number.

The user would then select the year to be displayed, and the program would perform a modulus calculation on the current cycle number to determine the correct record number to be retrieved, which will then display the associated day, date, shift start time, and platoon (i.e., what information to retrieve from memory and display).

The above described embodiments of the present invention are merely descriptive of its principles and are not to be considered limiting. The scope of the present invention instead shall be determined from the scope of the following claims including their equivalents.

What is claimed is:

1. A user programmable scheduling watch for recording and allowing access to a regular schedule of shifts, both prospective and retrospective comprising:
   - timing means for producing a series of regular clock pulses;
   - memory means for storing a calendar covering a plurality of years;
   - display means for displaying day, date and time functions coupled to said timing means and said memory means;
   - first user controlled input means for inputting into said memory means user selected number of intervals of time into which each 24 hour day period is divided;
   - second user controlled input means for inputting into said memory means an indicia representing a repeating designation with one designation assigned to each user selected time interval throughout a calendar period in said memory means;
   - third user controlled input means for inputting an arbitrary user selected duty cycle period of days for said repeating designation;
   - and means responsive to said second user controlled input means for assigning a repeating designation to each time interval selected by the user throughout said calendar period in said memory means;
   - one of said user controlled input means being operative for inputting any date and time period in said calendar period; and
   - means for controlling said display means to display an indicia representing the repeating designation assigned to said selected date and time period.

2. A watch in accordance with claim 1 wherein said memory means comprises a read only ROM memory for storing said calendar and a random access RAM for storing user input information and wherein said calendar period said repeating designation number is input is the full calendar stored in said read only ROM memory.

3. A watch in accordance with claim 1 wherein said first, second and third inputting means comprise a series of switches on said watch.

4. A watch in accordance with claim 1 wherein said watch includes means for calculating the division of each 24 hour day by the number of intervals input by the user.

5. A watch in accordance with claim 1 wherein said watch includes means for storing said cycle period.

6. A watch in accordance with claim 1 wherein said first user controlled input means inputs a number from 1to 3.

7. A watch in accordance with claim 6 wherein said first user controlled input means cycles through the numbers from 1 through 3 with repeated operation of said input means.

8. A watch in accordance with claim 2 wherein said second user controlled input means inputs up to four indicia.

9. A watch in accordance with claim 1 wherein said indicia comprise initial letters of the alphabet each designating a different shift and display means is operative to display the letter of the alphabet corresponding to the present date and time.

10. A watch in accordance with claim 1 wherein said display means is operative to display the letter of the alphabet corresponding to a date and time other than the present date or time responsive to the display of such different date and time under the control of the user by operation of selected input means.

11. A watch in accordance with claim 1 wherein a preselected order of operation of said input means enables said memory means to set the present date and time.

12. A watch in accordance with claim 1 wherein a second preselected order of operation of said means enables said memory means to display any selected date in time within the range of the calendar stored in said memory means.

13. A watch in accordance with claim 3 wherein a fourth preselected order of operation of said input means enables said memory means to set the number of shifts per day, month, day, year, shift start time in hours and minutes, and platoon indicia for a particular shift schedule.

14. A watch in accordance with claim 3 wherein a fifth preselected order of operation of said input means enables said memory means to review the number of shifts per day, month, day, year, shift start time in hours and minutes, and platoon indicia for a particular shift schedule.

15. A watch in accordance with claim 3 wherein a sixth preselected order of operation of said input means enables said memory means to start and stop the chronograph or time function, and to set and reset the lap function.

16. A watch in accordance with claim 3 wherein a seventh preselected order of operation of said input means enables said memory means to enable or disable the chime function.

17. A programmable scheduling computerized device for recording and allowing access to a regular schedule of shifts both prospective and retrospective and allowing the display thereof comprising;

timing means for producing a series of regular clock pulses;

memory means for storing a calendar covering a plurality of years;

display means for displaying day, date and time functions coupled to said timing means and said memory means;

first controllable input means for inputting into said memory means a user selected number of intervals of time into which each 24 hour day period is divided;

second controllable input means for inputting into said memory means an indicia representing a repeating designation with one designation assigned to each time interval throughout a calendar period in said memory means;

third user controllable input means for inputting an arbitrary user selected duty cycle period of days for said repeating designation;

and means responsive to said input means for assigning a repeating designation to each time interval throughout said calendar period in said memory means;

one of said controllable input means being operative for inputting any date and time period in said calendar period; and means for controlling said display means to display an indicia representing the repeating designation assigned to said selected date and time period.

18. A device in accordance with claim 17 wherein said memory means comprises a read only ROM memory for storing said calendar and a random access RAM for storing user input information and wherein said calendar period said repeating designation number is input is the full calendar stored in said read only ROM memory.

19. A device in accordance with claim 17 wherein said includes means for calculating the division of each 24 hour day by the number of intervals input by the user.

20. A device in accordance with claim 17 wherein said device includes means for storing said cycle period.

21. A device in accordance with claim 17 wherein said first user controlled input means inputs a number from 1 to 3.

22. A device in accordance with claim 21 wherein said first user controlled input means cycles through the numbers from 1 through 3 with repeated operation of said input means.

23. A device in accordance with claim 18 wherein said second user controlled input means inputs up to four indicia.

24. A device in accordance with claim 17 wherein said indicia comprise initial letters of the alphabet each designating a different platoon and display means is operative to display the letter of the alphabet corresponding to the present date and time.

25. A device in accordance with claim 17 wherein said display means is operative to display the letter of the alphabet corresponding to a date and time other than the present date or time responsive to the display of such different date and time under the control of the user by operation of selected input means.

26. A device in accordance with claim 17 wherein a preselected order of operation of said input means enables said memory means to set the present date and time.

27. A device in accordance with claim 17 wherein a second preselected order of operation of said input means enables said memory means to display any selected date in time within the range of the calendar stored in said memory means.

* * * * *